US007249397B2

(12) United States Patent
Abels et al.

(10) Patent No.: US 7,249,397 B2
(45) Date of Patent: Jul. 31, 2007

(54) HINGED LATCH DEVICE WITH ELONGATE STRAP HINGE

(76) Inventors: Norbert Abels, Alleestriasse 30a, 66424 Homburg (DE); Claus-H. Backes, St. Wendeler Strasse 45, 66113 Saarbrücken (DE)

( * ) Notice: Subject to any disclaimer, the term of this patent is extended or adjusted under 35 U.S.C. 154(b) by 0 days.

(21) Appl. No.: 10/836,058

(22) Filed: Apr. 30, 2004

(65) Prior Publication Data

US 2005/0241120 A1 Nov. 3, 2005

(51) Int. Cl.
*A44B 21/00* (2006.01)
*A61C 3/00* (2006.01)

(52) U.S. Cl. ..... 24/132 R; 24/129 R; 433/10

(58) Field of Classification Search ..... 24/129 R, 24/132 R, 132 WL, 327, 573.09, 545, 557, 24/570; 16/221, 231, 232, 250; 433/10, 433/8, 9, 11

See application file for complete search history.

(56) References Cited

U.S. PATENT DOCUMENTS

| | | | | | |
|---|---|---|---|---|---|
| 3,323,208 | A | * | 6/1967 | Hurley, Jr. | 606/120 |
| 3,530,550 | A | | 9/1970 | White | 24/245 |
| 3,612,475 | A | | 10/1971 | Dinger | 251/10 |
| 3,698,681 | A | * | 10/1972 | Lacey | 251/10 |
| 3,713,622 | A | | 1/1973 | Dinger | 251/10 |
| 3,729,045 | A | | 4/1973 | MacDonald | 160/371 |
| 3,912,140 | A | * | 10/1975 | Franges | 294/166 |
| 4,038,726 | A | * | 8/1977 | Takabayashi | 24/198 |
| 4,077,085 | A | * | 3/1978 | Yuda | 174/153 G |
| 4,193,174 | A | * | 3/1980 | Stephens | 24/532 |
| 4,227,730 | A | | 10/1980 | Alexander et al. | 294/16 |
| 4,387,489 | A | * | 6/1983 | Dudek | 24/133 |
| 4,492,573 | A | | 1/1985 | Hanson | 433/11 |
| 4,534,089 | A | | 8/1985 | Swan | 24/559 |
| 4,635,823 | A | | 1/1987 | Stull | 222/108 |
| 4,638,804 | A | | 1/1987 | Jewusiak | 128/325 |
| 4,669,156 | A | * | 6/1987 | Guido et al. | 24/336 |
| 4,712,999 | A | * | 12/1987 | Rosenberg | 433/8 |
| 4,821,789 | A | * | 4/1989 | Van Rens | 160/176.1 R |
| 4,834,096 | A | | 5/1989 | Oh et al. | 128/325 |
| 4,844,519 | A | | 7/1989 | Dagon | 292/57 |
| 5,109,576 | A | | 5/1992 | Teekell et al. | 24/30.5 R |

(Continued)

FOREIGN PATENT DOCUMENTS

| | | |
|---|---|---|
| DE | 10026099 | 11/2001 |

(Continued)

*Primary Examiner*—Robert J. Sandy
*Assistant Examiner*—Andre' L. Jackson
(74) *Attorney, Agent, or Firm*—Workman Nydegger

(57) ABSTRACT

A latch device comprises a base suitable for attachment to a substrate, a cover, an elongate strap hinge that connects the base and cover, a hinge guide structure and/or a camming structure, and a locking mechanism. The cover is selectively movable about the strap hinge relative to the base between an open position and a closed position. The hinge guide structure includes a curved surface proximal to the elongate strap hinge that assists in distributing forces throughout a significant portion of the entire length of the strap hinge as the cover is moved relative to the base. A camming structure may be included that has a camming surface that biases the cover toward the open position. The latch device is useful in a variety of areas, including tie downs for sail boats, campers, tarps, suit cases, back packs, and other sporting goods.

18 Claims, 8 Drawing Sheets

U.S. PATENT DOCUMENTS 5,653,411 A * 8/1997 Picco et al. ..... 248/74.1
5,685,711 A * 11/1997 Hanson ..... 433/11
5,829,105 A * 11/1998 Matoba et al. ..... 24/115 F
6,071,119 A 6/2000 Christoff et al. ..... 433/14
6,112,934 A 9/2000 Jung et al. ..... 220/315
6,616,445 B2 9/2003 Abels et al. ..... 433/11
6,655,958 B2 * 12/2003 Abels et al. ..... 433/10
2002/0110778 A1 8/2002 Abels et al. ..... 433/11
2003/0189340 A1 10/2003 Kitzis ..... 292/145

FOREIGN PATENT DOCUMENTS

WO WO 2004/078057 9/2004

* cited by examiner

HINGED LATCH DEVICE WITH ELONGATE STRAP HINGE

BACKGROUND OF THE INVENTION

1. The Field of the Invention

The present invention relates to a latch device that may be used in a variety of areas, for example, tie downs for boats, campers, tarps, suit cases, back packs, and other sporting goods.

2. The Relevant Technology

Latch devices are used in a variety of areas to clamp or otherwise secure various articles. Existing devices can be rather complex, difficult to use, and often wear out prematurely. Because of these difficulties, there is a need for a simple, easy to use, durable latch device which can be used to secure a wide range of articles such as tie downs for boats, campers, tarps, suit cases, back packs, and other sporting goods.

It would be an improvement in the art to provide a latch device that is easy to open and close without use of any special tools or excessive force, that can be manufactured at low cost, and that exhibits high durability.

BRIEF SUMMARY OF THE PREFFERED EMBODIMENTS

The present invention is directed to a latch device that may be used in a variety of areas, including tie downs for boats, campers, tarps, suit cases, back packs, and other sporting goods.

The latch device includes a base that is suitable for attachment to a substrate, an elongate strap hinge, a cover that is attached to the base by the elongate strap hinge, a camming structure, and a locking mechanism. The cover moves about the strap hinge between open and closed positions relative to the base.

The camming structure may be disposed on the cover or on the base. It includes a curved surface around which the elongate strap hinge bends when the cover is selectively moved relative to the base so that the elongate strap hinge bends over a significant portion of its entire length. The article to be held is placed between on the base (e.g., in a slot formed within the base) and then the cover is subsequently closed and locked to the base.

Because the elongate strap hinge bends around the curved surface of the camming structure, the strap hinge is especially resistant to breakage. The curved surface prevents kinking and concentration of the stresses and forces associated with the operation of the hinge that might otherwise occur. Because the elongate strap hinge bends around the curved surface of the camming structure, the stresses and forces are distributed along a significant portion of the length of the strap hinge.

According to one embodiment, the curved surface of the camming structure is disposed on the base, adjacent to the elongate strap hinge. In addition to the curved surface, the camming structure may also include a camming surface that is located opposite the curved surface. The camming surface interacts with the base so as to bias the cover towards an open position.

According to one embodiment, the camming structure fits within and substantially fills a void space between the base and the elongate strap hinge when the cover is in the closed position.

The latch device may be formed integrally as a single piece, for example, by injection molding of a thermoplastic material.

According to one embodiment, the elongate strap hinge has a cross-sectional thickness that is less than the thickness of the cover and base where the cover and base are attached to the elongate strap hinge.

The locking mechanism may be any mechanism which holds the cover against the base in a closed position. Exemplary locking mechanisms may include a cotter pin inserted through a hole formed through the cover and the base, a bolt and nut for locking the cover to the base, a threaded auger screw that is threaded through the cover and base, locking them together, or a locking pin that inserts through a slot in the cover and base, or mechanical interaction or interlocking between the cover and base themselves. These exemplary locking mechanisms are illustrative, and many others could alternatively be used.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by references to specific embodiments thereof, which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

A detailed description of the latch device of the invention will now be provided with specific reference to the drawings illustrating preferred embodiments of the invention. It will be appreciated that like structures will be provided with like reference designations. The latch device includes a base suitable for attachment to a substrate, an elongate strap hinge, a cover attached to the base by the elongate strap hinge, a camming structure, and a locking mechanism.

Figure 1A:
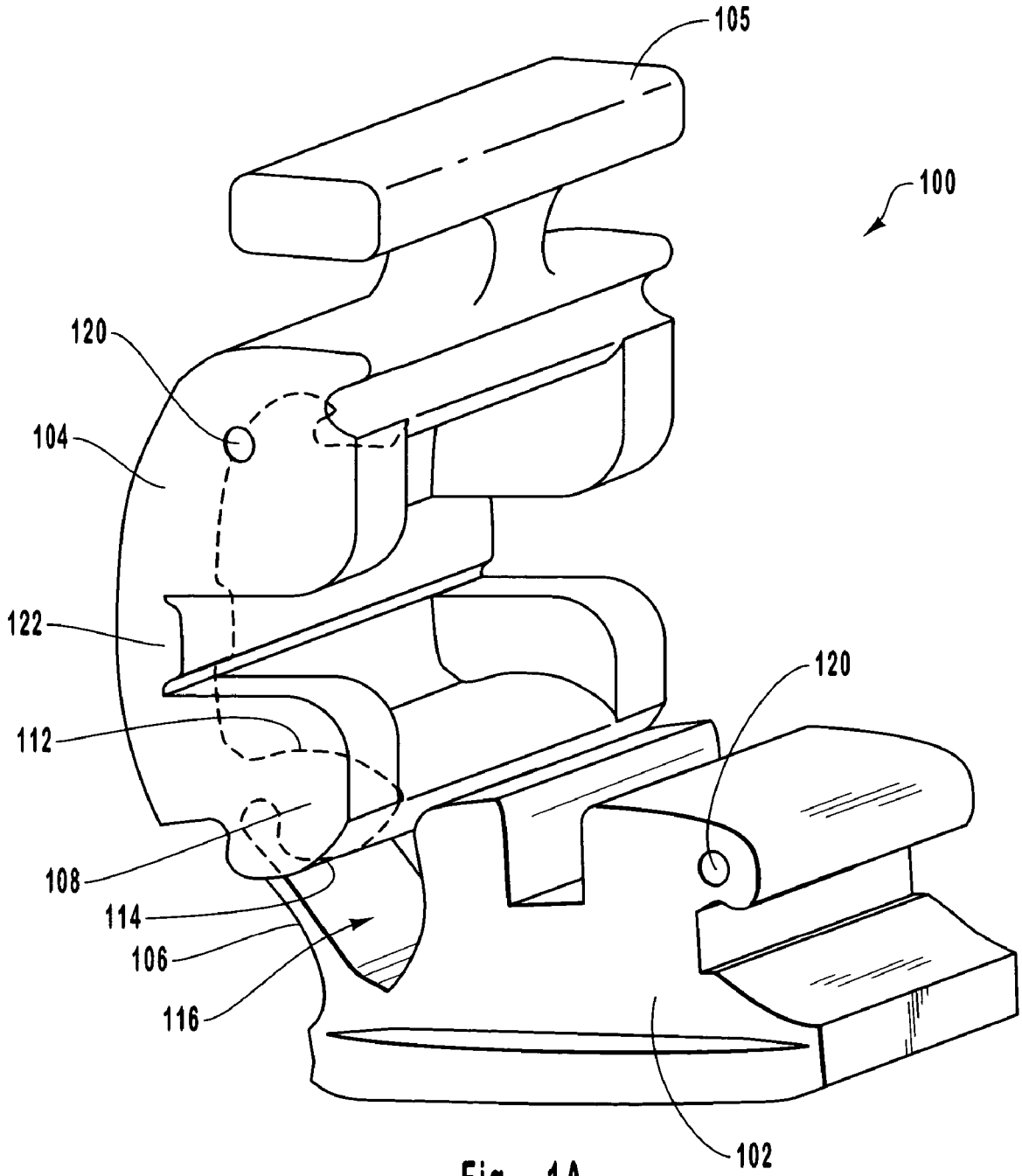
FIGS. 1A-1C are perspective views of an exemplary latch device that is being used for securing a line to a boat.
Figure 1B:
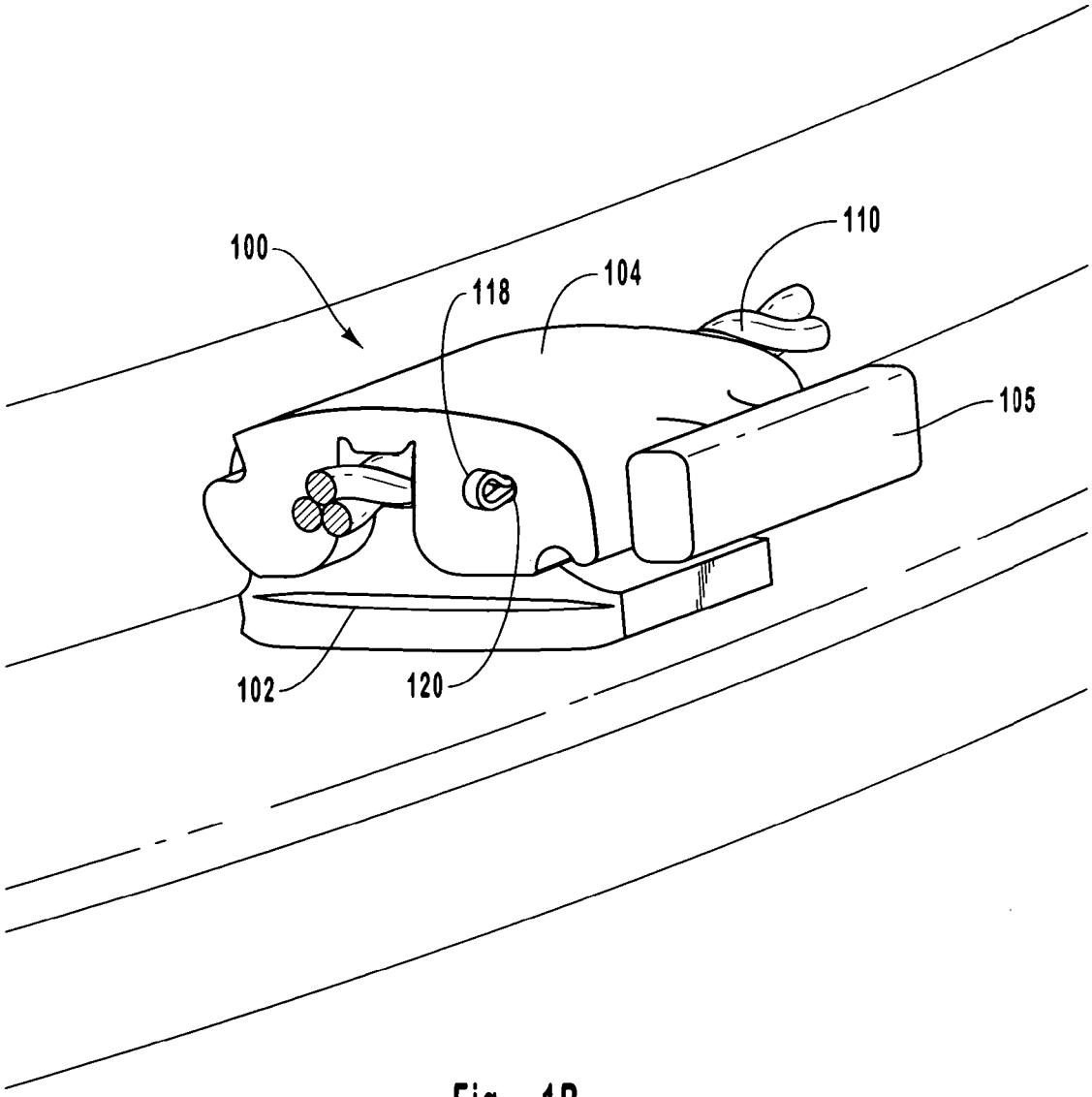

FIGS. 1A and 1B depict a latch device 100 having a base 102 to which a cover 104 is hingedly attached. The latch device 100 further includes an elongate strap hinge 106 that is attached at one end to the base 102 and at an opposite end to the cover 104. In this way, the cover 104 is hingedly attached to the base 102 and is able to be selectively moved (e.g., rotated) between an open position and a closed position relative to the base 102. The latch device also includes a camming structure 108, and a locking mechanism. In a preferred embodiment, the latch device can be made (e.g., by injection molding) from a single type of material, e.g., a thermoplastic material.

Because the strap hinge 106 of the latch device 100 is elongated, it is able to bend gradually over a significant portion of its entire length rather than at a single point or line. This results in a hinge that is more resilient and durable over time because it is not overly bent or stressed at any particular point or line. Moreover, because the elongate strap hinge 106 can bend gradually over a significant portion of its entire length, it can be of a thicker, stronger construction compared to a hinge that is required to bend at a single point or line. This results in a hinge that is significantly stronger and more resistant to breakage than it might otherwise be.

In some embodiments, the elongate strap hinge 106 will have a cross-sectional thickness that is less than the cross-sectional thicknesses of the adjoining cover 104 and base 102. Nevertheless, it is within the scope of the invention for the elongate strap hinge 106 to have a material cross section that is as thick or thicker than the adjoining cover 104 and/or base 102.

According to one aspect of the invention, the elongate strap hinge 106 may be constructed so that the cover 104 remains in an open position relative to the base 102 when the strap hinge 106 is in a relaxed condition. The ability of the cover 104 to remain in the open position without having to apply force to the cover 104 helps facilitate placement of an article (e.g., a rope 110) to be clamped between the cover 104 and the base 102.

The latch device 100 includes a camming structure 108 that includes a curved surface that interacts with the elongate strap hinge 106 to assist in causing the hinge 106 to bend gradually along a significant portion of its entire length as the cover 104 is selectively moved between open and closed positions relative to the base 102. The camming structure and curved surface may either comprise an integral part of the cover 104 or base 102, or alternatively, a separate piece attached to the cover 104 or base 102. In the embodiment illustrated in FIGS. 1A and 1B, the camming structure 108 is integrally attached to the cover 104.

In FIG. 1A, camming structure 108 is illustrated as having a camming surface 112 and a curved hinge-guiding surface 114. The hinge-guiding surface 114 is an example of a curved surface that interacts with the elongate strap hinge 106 to assist in gradually bending the strap hinge 106 along a significant portion of its entire length as the cover 104 is moved relative to the base 102. The hinge-guiding surface 114 is advantageously curved so as to interact with the elongate strap hinge 106 by distributing forces along a significant portion of its entire length as the cover 104 is moved. Distributing forces along a significant portion of the length of the elongate strap hinge 106, rather than allowing the forces to concentrate at a single location, results in a hinged latch device that is more resistant to breakage of the hinge compared to devices in which the hinge is bent abruptly at a specific point or line. In one embodiment, the hinge-guiding surface 114 may help maintain the cover 104 (in combination with an exemplary locking mechanism discussed more fully below) in the locked position by exerting outward pressure against the elongate strap hinge 106. This, in turn, effectively shortens the length of the cover 104, thereby causing the exemplary locking mechanism to hold the cover 104 more tightly (e.g., so as to remove play).

The camming surface 112 is curved or angled in such a way so that it interacts with the base 102 in order to bias the cover 104 toward the open position when the cover 104 is in an unlocked configuration relative to the base 102. This improves access to the inside clamping surfaces of the base 102 and cover 104, facilitating insertion or removal of an article to be held.

In the embodiment illustrated in FIG. 1A, camming structure 108 is integrally attached to the inner surface of the cover 104 in a manner so as to extend toward the base 102. Further, and as is shown in particular in FIG. 1B, the camming structure 108 is received within a recess 116 between the base 102 and the elongate strap hinge 106 when the cover 104 is in the closed position. This results in a more compact latch device 100.

Figure 1C:
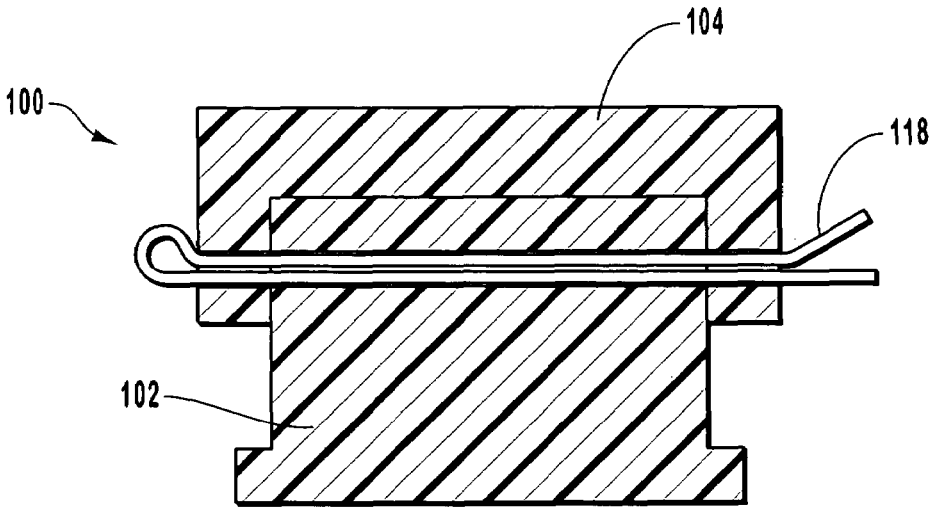

The latch devices according to the invention include a locking mechanism for maintaining the cover 104 in a closed position once the cover has been closed. As shown in FIGS. 1B and 1C the illustrated embodiment shows an exemplary locking mechanism in which a cotter pin 118 is inserted through a hole 120 formed through the cover 104 and base 102. It will be appreciated that any locking mechanism known in the art may be used to selectively lock and unlock the cover 104 relative to the base 102.

The latch device may further include a bearing protrusion 122 and corresponding slot 124. Bearing protrusion 122 may be provided on the inside and middle of the cover 104 that extends toward the slot 124 when the cover 104 is in the closed position. The bearing protrusion 122 assists in fixing an article (e.g., a rope, cable, strap, ring, bar, rod, pin, and the like) to be clamped within the slot 124 when the cover is in the closed state (FIG. 1B).

Figure 2A:
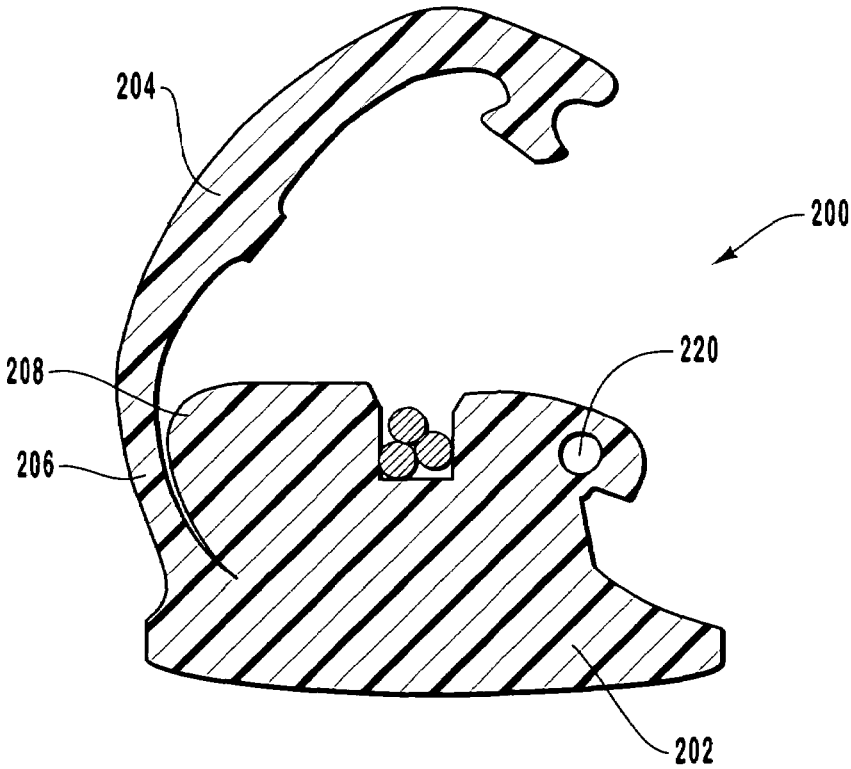
FIGS. 2A-2C illustrate an alternative latch device according to the invention.
Figure 2B:
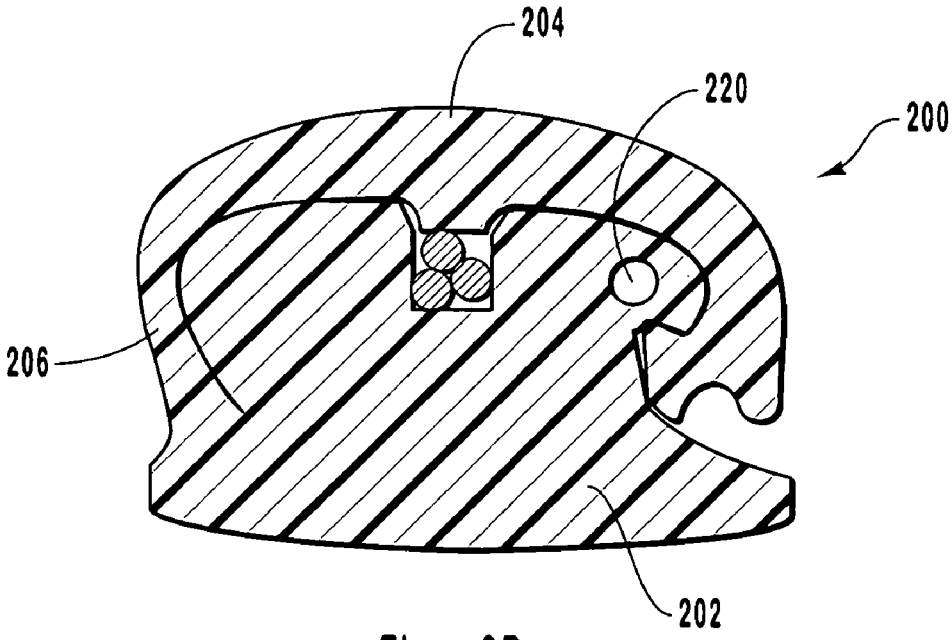
Figure 2C:
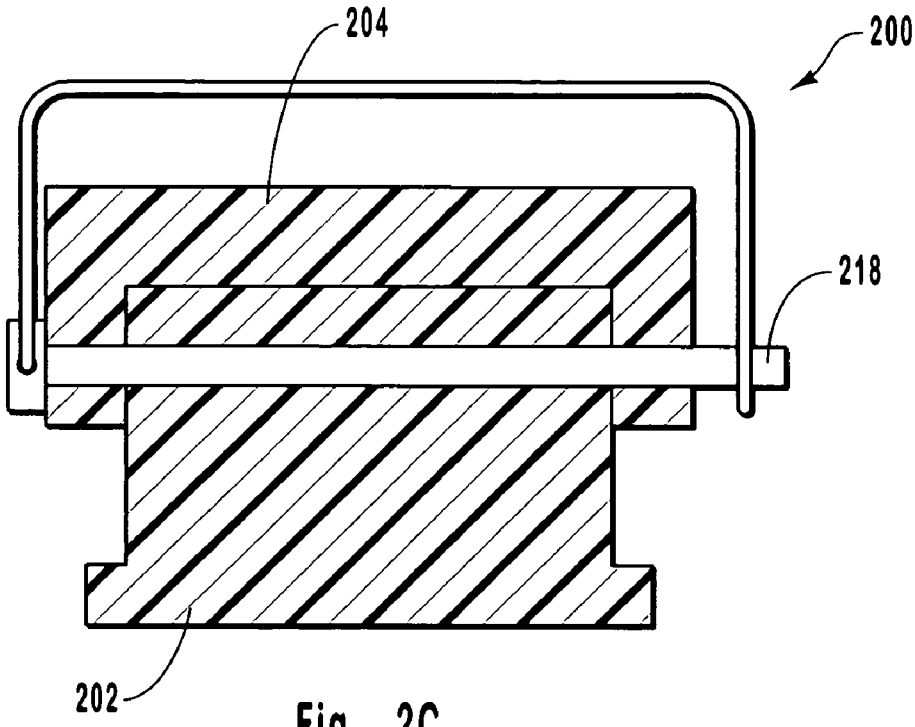

FIGS. 2A and 2B depict an alternative embodiment of a latch device 200 according to the invention that includes a simplified hinge guide structure disposed on the base. The latch device 200 depicted in FIGS. 2A and 2B includes a base 202 and a cover 204 attached to the base 202 by means of an elongate strap hinge 206. The base 202 further includes a curved end surface 208 that acts as a hinge guide in order to cause the elongate strap hinge 206 to bend gradually over a significant portion of its entire length. In this way, the curved end surface 208 of the base 202 act in similar manner to the curved hinge-guiding surface 114 of the camming structure 108 of the latch device 100 depicted in FIG. 1A-1B. Thus, as the cover 204 is moved from an open position (FIG. 2A) to a closed position (FIG. 2B), the elongate strap hinge 206 at least partially abuts the curved end surface 208. The abutment between the elongate strap hinge 206 and the curved end surface 208 causes the elongate strap hinge 206 to bend gradually around the curved end surface 208 so as to better distribute the bending forces and bending angles along substantially the entire length of the elongate strap hinge 206.

Figure 3A:
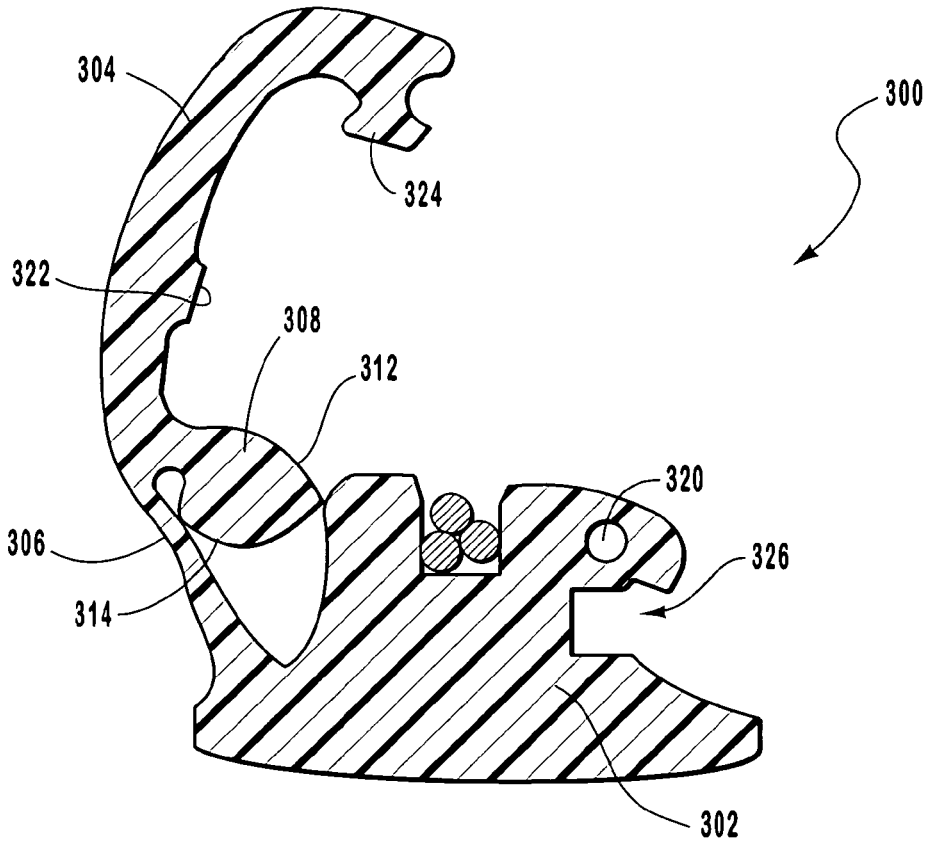
FIGS. 3A-3D illustrate operation of a latch device according to the invention that includes mechanically interlocking structures provided by the base and cover.

FIG. 3A is a side view that shows another embodiment of a latch device 300 with the cover 304 in an open position relative to the base 302. The cover 304 can be manually opened by rotating it about the elongate strap hinge 306 so that the camming structure 308 just barely abuts an upper surface of the base 302. It will be appreciated, however, that, depending on the nature of the elongate strap hinge 306, it is possible for the cover 304 to be biased either toward or away from the base 302 when the cover 304 is in a fully open position relative to the base 302. In the embodiment shown in FIG. 3A, however, the elongate strap hinge 306 gently biases the cover 304 toward the base 302 in order for the camming structure 308 to lightly contact an upper surface of the base 302 while the cover 304 is in an open position relative to the base 302.

Figure 3B:
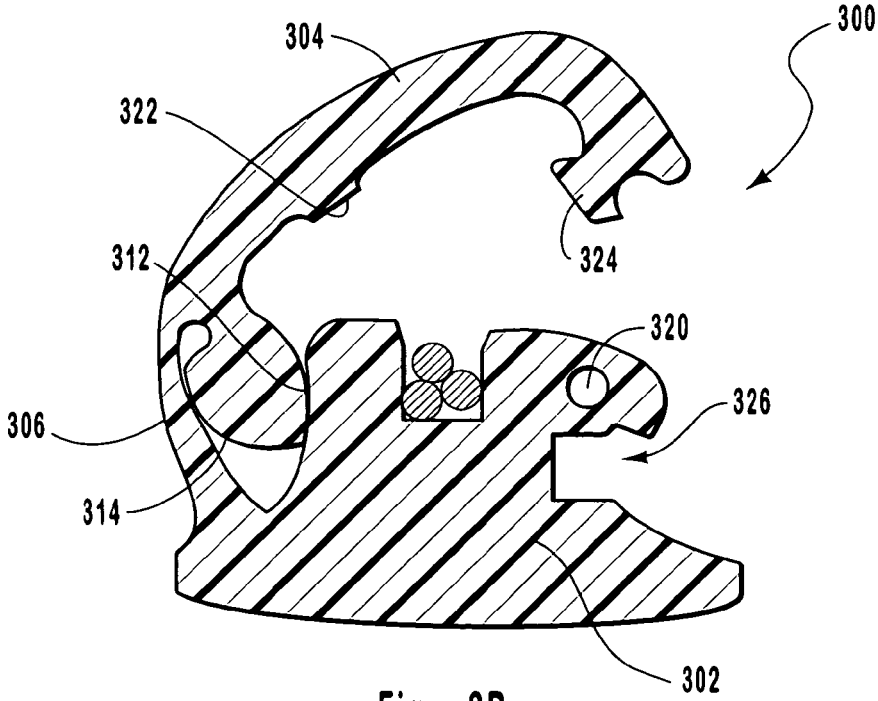

As seen in FIG. 3B, when the cover 304 is pushed down toward the base 302, the camming surface 312 of the camming structure 308 makes abutting contact with, and slides against, an upper surface of the base 302, thereby causing the camming structure 308 to be biased in a spring-like fashion towards the elongate strap hinge 306. As a result, the camming structure 308 can act as a spring that exerts an opposing biasing force that, in combination with the camming action of camming surface 312, biases or urges the cover 304 toward the open position relative to the base 302. Thus, if the latch device 300 is in the conformation depicted in FIG. 3B and the cover 304 is released, it may spontaneously spring back to a conformation like the one illustrated in FIG. 3A. It should be understood, however, that the exact resting conformation of the cover 304 is dependent upon the size, shape and relative positions of the camming structure 308 and the upper surface of the base 302 with which it comes into contact.

Figure 3C:
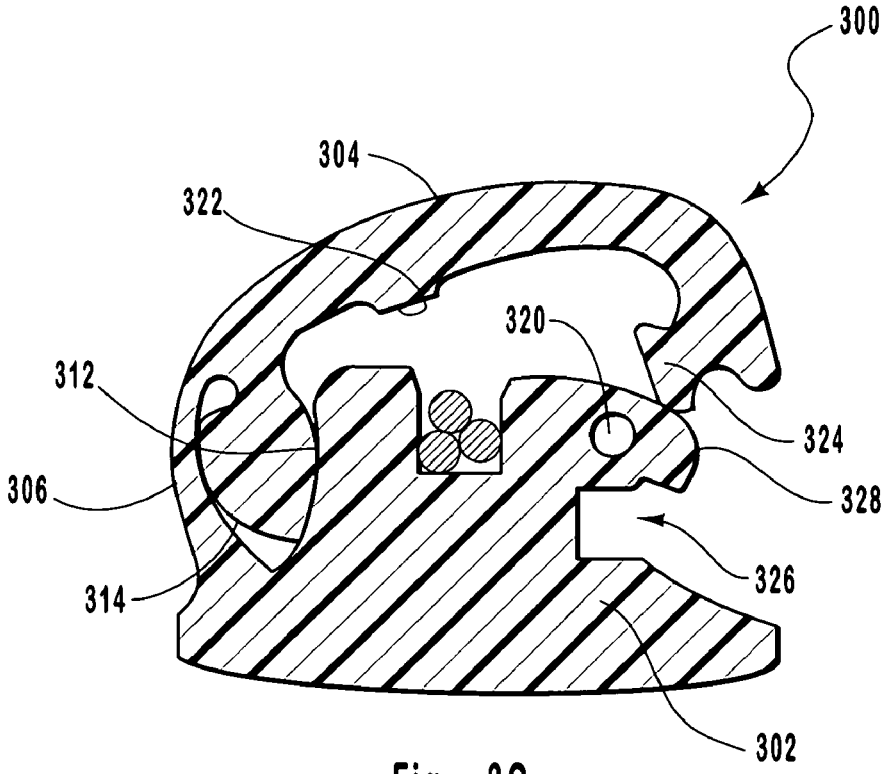
Figure 3D:
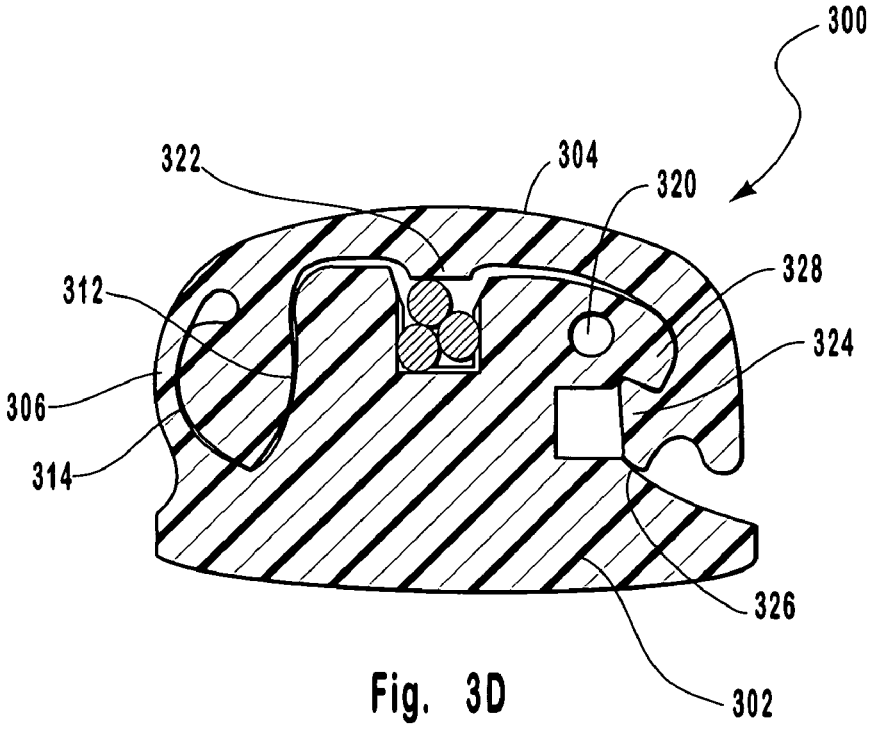

As the cover 304 is pushed down further toward the base 302 as seen in FIG. 3C, the camming surface 312 of the camming structure 308 continues to make contact with the base 302, thus pushing the camming structure 308 further toward the elongate strap hinge 306. Thus, if the latch device 300 is in the conformation depicted in FIG. 3C, and the cover 304 is released, it will spontaneously spring back to a conformation like the one illustrated in FIG. 3A (subject to the actual size, shape and angles of the camming structure 308 and base 302). This tendency of the cover 304 to remain in an open position absent external force is advantageous to the user because it facilitates the insertion of an article to be held between the cover and the base.

Additionally, when the latch device 300 is in the conformation illustrated in FIG. 3C, the curved hinge-guiding surface 314 of the camming structure 308 is in contact with the inside surface of the elongate strap hinge 306. This contact between curved surface 314 and the elongate strap hinge 306 distributes forces associated with closing the cover 304 (i.e., while bending the hinge) gradually along the entire contact length between the curved surface 314 and the elongate strap hinge 306 as the cover 304 is progressively closed. This results in the elongate strap hinge 306 bending along its entire length, or at least a significant portion of its entire length, as the cover 304 is closed, rather than bending at a single point or line. This characteristic allows the elongate strap hinge 306 to bend without kinking, thereby decreasing the likelihood of fatigue and unwanted breakage. Because the elongate strap hinge 306 bends gradually along a significant portion of its entire length, rather than abruptly at a distinct localized bending angle, the film hinge 306 can be significantly thicker than film hinges that bend at a discrete localized bending angle. The combination of these characteristics results in a much stronger and more durable hinge that resists breakage when subjected to shearing or bending forces.

The cover 304 is held in a closed position by means of mechanical interaction between a locking protrusion 324 that extends from an end of the cover 304 opposite the strap hinge 306 and a locking recess 326 within the base 302. The locking protrusion 324 bends outwardly as the cover 304 is pushed beyond nose 328 on the base 302. to unlock the cover 304, the locking protrusion 324 is withdrawn from the locking recess 326 and flexed up and over nose 328. It should be understood that any combination of protrusions and recesses located on or attached to the cover 304 and/or base 302 may be utilized as the locking mechanism, either alone or in combination with any other locking devices disclosed herein or known in the art.

Figure 4:
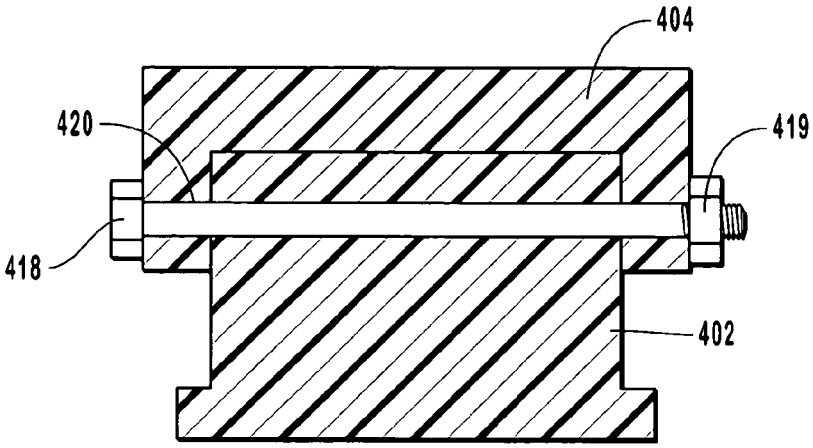
FIG. 4 illustrates an exemplary latch device that includes a locking mechanism comprising a threaded bolt that fits in a hole through the cover and base.

Alternative exemplary locking mechanisms are illustrated in FIGS. 4-8. FIG. 4 illustrates the use of a bolt 418 inserted through a hole 420 in the cover 404 and base 402. A nut 419 is fastened to the bolt 418 so as to secure the bolt 418 within the hole 420. The cover 404 can be selectively locked and unlocked relative to the base 402 by inserting and removing bolt 418 into and out of hole 420.

Figure 5:
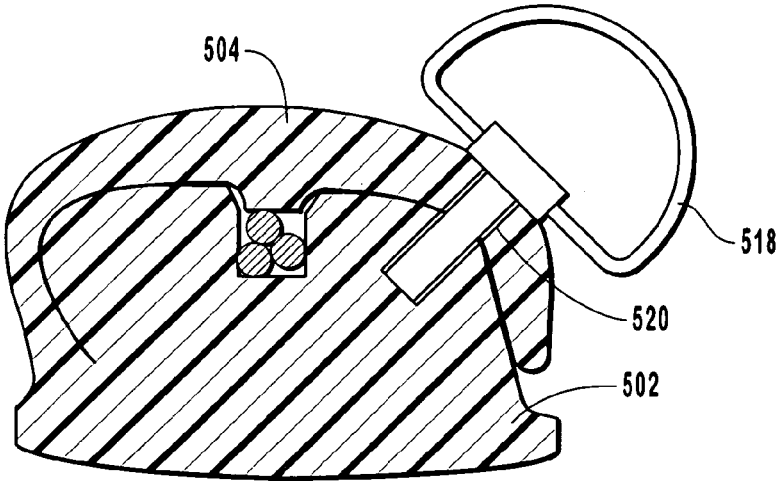
FIG. 5 illustrates an exemplary latch device that includes a locking mechanism comprising a pin that fits within corresponding holes in the cover and base.

FIG. 5 illustrates a pin 518 that is selectively inserted or withdrawn from a corresponding hole 520 in the front of cover 504 and base 502. The cover 504 can be selectively locked and unlocked relative to the base 502 by inserting and removing pin 518 into and out of hole 520.

Figure 6:
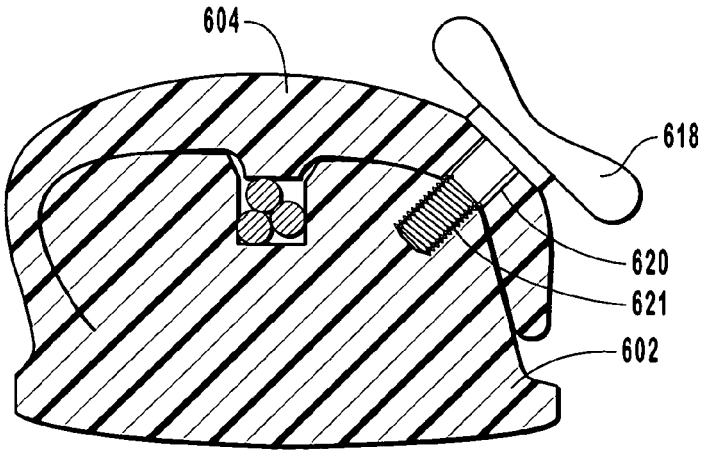
FIG. 6 illustrates an exemplary latch device that includes a locking mechanism comprising a threaded auger screw that passes through a hole in the cover and threadably mates with a threaded hole in the base.

FIG. 6 illustrates use of a threaded auger screw 618 which is passed through a hole 620 in the front of cover 604 and screwed into a threaded hole 621 in the front of base 602 so as to selectively secure and release the cover 604 to and from the base 602.

Figure 7:
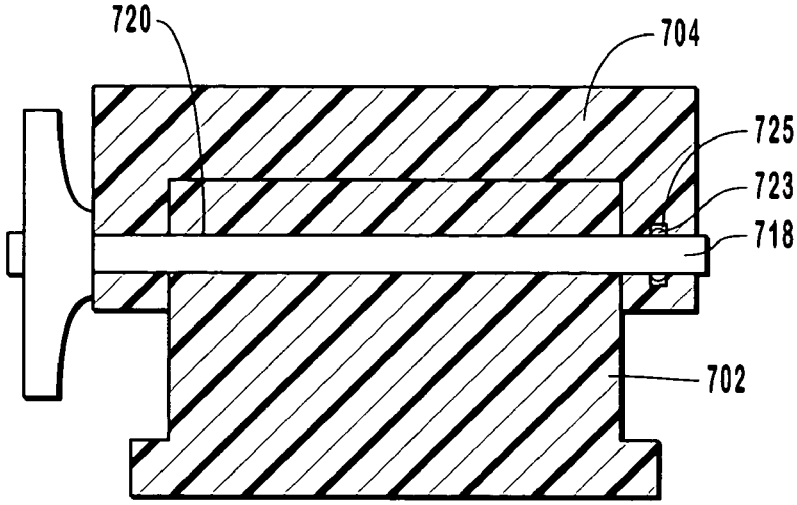
FIG. 7 illustrates a latch device that includes a locking mechanism comprising a locking pin that includes a locking tongue that fits in a recess or groove in the cover.

FIG. 7 illustrates a locking pin 718 which is inserted through a hole 720 and turned in order for a locking tongue 723 to fit within a recess or groove 725 in the cover 704 so as to selectively secure and release the cover 704 to and from the base 702.

Figure 8:
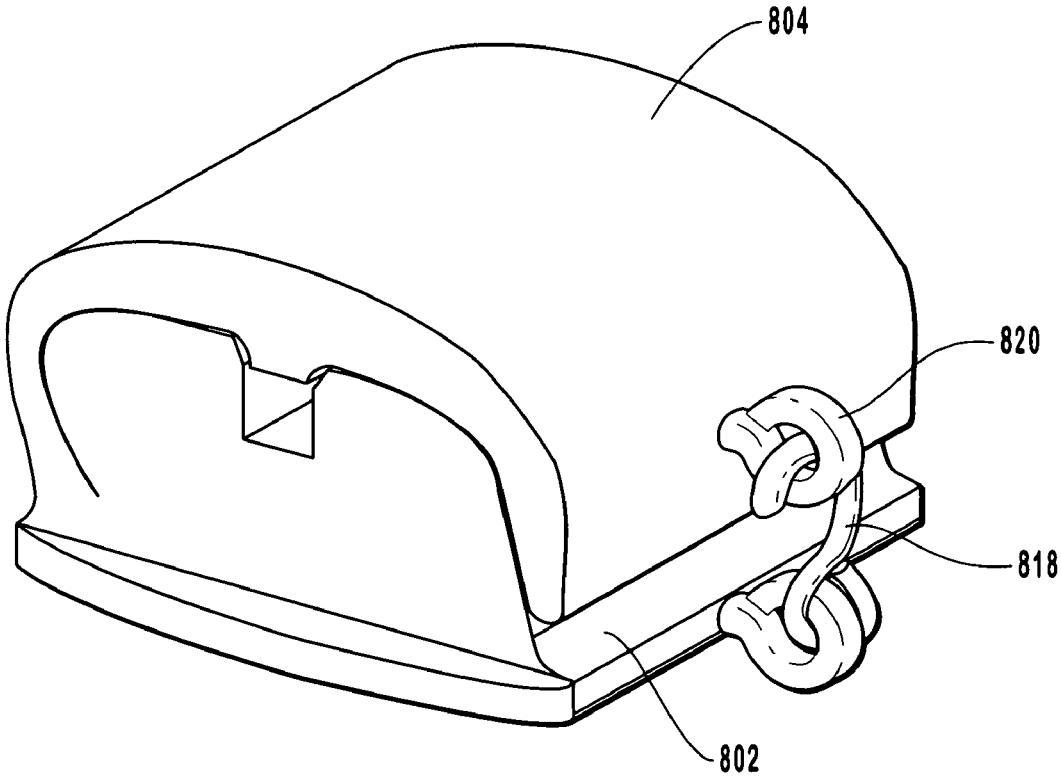
FIG. 8 illustrates an exemplary latch device that includes a locking mechanism comprising a rotatable latch on the base that fits into an eyelet on the cover.

FIG. 8 illustrates a locking mechanism that includes a latch 818 rotatably connected to the base 802 that can be selectively inserted into and withdrawn from an eyelet 820 attached to or formed on cover 804.

The foregoing locking mechanisms are exemplary, and any locking mechanism capable of securing the cover to the base may be used.

It should be understood that the general concept of a cover attached to a base by means of an elongate strap hinge and a curved surface that helps the strap hinge bend along a substantial portion of its length and/or a camming surface that biases the cover toward an open position can be generalized to be usable together with other known mechanisms or devices. For example, rather than being attached to a base, the cover might be attached to, for example, a box or other container by means of an elongate strap hinge. A curved, hinge guide structure and/or an interactive camming surface that biases the cover toward the open position may also be included in order for the benefits disclosed herein to be extended to lids or covers that can be selectively moved between open and closed positions relative to a box, container, or other substrate.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A latch device comprising:

a base suitable for attachment to a substrate;

an elongate strap hinge having a proximal end affixed to the base and a distal end affixed to a cover that is hingedly attached to the base by the elongate strap hinge so that the cover is movable about the strap hinge between an open position and a closed position relative to the base by bending the strap hinge, the elongate strap hinge comprising the sole means of interconnecting the cover and base;

a slot in the base that is spaced apart and separated from the strap hinge by a portion of the base so that an object disposed in the slot during use is prevented from contacting the strap hinge when the cover is in the closed position;

a bearing protrusion positioned on the cover that is sized and configured so as to reside partially within the slot without touching the base when the cover is in the closed position;

a hinge guide structure disposed on the cover or base, the hinge guide structure providing a curved surface around which at least a portion of the elongate strap hinge bends when the cover is selectively moved to the closed position relative to the base so that the elongate strap hinge bends over a significant portion of its entire length, at least a substantial portion of the strap hinge contacting the curved surface when the cover is in the closed position; and a locking mechanism that selectively locks and unlocks the cover relative to the base.

2. A latch device as recited in claim 1, the hinge guide structure forming an integral part of the base and not any portion of the cover.

3. A latch device as recited in claim 1, the hinge guide structure forming part of a camming structure that extends from an undersurface of the cover and includes a camming surface that interacts with the base so as to bias the cover toward the open position in order for the slot to remain substantially unoccluded by the cover absent application of a force sufficient to move the cover to the closed position.

4. A latch device comprising:

a base suitable for attachment to a substrate;

an elongate strap hinge having a proximal end affixed to the base and a distal end affixed to a cover that is hingedly attached to the base by the elongate strap hinge so that the cover is movable about the strap hinge between an open position and a closed position relative to the base by bending the strap hinge;

a slot in the base that is spaced apart and separated from the strap hinge by a portion of the base so that an object disposed in the slot during use is prevented from contacting the strap hinge when the cover is in the closed position;

a hinge guide structure that forms an integral part of the base and not any portion of the cover, the hinge guide structure providing a curved surface integral to the base around which at least a portion of the elongate strap hinge contacts and bends when the cover is selectively moved to the closed position relative to the base so that the elongate strap hinge bends over a significant portion of its entire length, at least a substantial portion of the strap hinge contacting the curved surface integral to the base when the cover is in the closed position; and a locking mechanism that selectively locks and unlocks the cover relative to the base.

5. A latch device as recited in claim 4, wherein the curved surface is disposed on the base, adjacent to the elongate strap hinge.

6. A latch device as recited in claim 4, wherein the curved surface interacts with the elongate strap hinge so as to distribute bending forces along a significant portion of the entire length of the elongate strap hinge when the cover is selectively moved relative to the base.

7. A latch device as recited in claim 1, wherein the elongate strap hinge has a cross-sectional thickness that is less than the cross-sectional thicknesses of the cover and base where the cover and base are attached to the elongate strap hinge.

8. A latch device as recited in claim 1, wherein the locking mechanism comprises at least one of a cotter pin, a bolt and nut, a threaded auger screw, a locking pin, or a latch insertable in an eyelet.

9. A latch device as recited in claim 1, wherein the locking mechanism comprises at least one of a protrusion in the cover that fits in a corresponding recess of the base or a protrusion in the base that fits in a corresponding recess in the cover.

10. A latch device as recited in claim 1, wherein the base, cover, and elongate strap hinge are integrally formed together as a single piece.

11. A latch device as recited in claim 10, wherein the latch device is formed by injection molding a thermoplastic material so that the base, cover, elongate strap hinge, and hinge guide structure are fused together as a single continuous piece of material.

12. A latch device comprising:

a base suitable for attachment to a substrate;

an elongate strap hinge having a proximal end affixed to the base and a distal end affixed to a cover that is hingedly attached to the base by the elongate strap hinge so that the cover is movable about the strap binge between an open position and a closed position relative to the base by bending the strap hinge;

a slot in the base that is spaced apart and separated from the strap hinge by a portion of the base so that an object disposed in the slot during use is prevented from contacting the strap hinge when the cover is in the closed position; and a camming structure extending from an undersurface of the cover and including a camming surface that interacts with the base so as to bias the cover toward the open position in order for the slot to remain substantially unoccluded by the cover absent application of a force sufficient to move the cover to the closed position, wherein the camming structure further includes a curved surface opposite the camming surface that acts as a hinge guide around which at least a portion of the elongate strap hinge contacts and bends when the cover is selectively moved to the closed position relative to the base so that the elongate strap hinge bends over a significant portion of its entire length.

13. A latch device as recited in claim 12, further comprising a locking mechanism which comprises at least one of a cotter pin, a bolt and nut, a threaded auger screw, a locking pin, or a latch insertable in an eyelet.

14. A latch device as recited in claim 12, further comprising a locking mechanism which comprises at least one of a protrusion in the cover that fits in a corresponding recess of the base or a protrusion in the base that fits in a corresponding recess in the cover.

15. A latch device as recited in claim 12, wherein the base, cover, elongate strap hinge and camming structure are integrally formed together as a single piece.

16. A latch device as recited in claim 15, wherein the latch device is formed by injection molding a thermoplastic material so that the base, cover, elongate strap hinge, and camming structure are fused together as a single continuous piece of material.

17. In a latch device that includes a substrate and a cover mechanism hingedly attached to the substrate, the cover mechanism comprising:

a cover;

an elongate strap hinge that is affixed at one end to the cover and that includes an opposite end affixed to the substrate so that the cover is movable about the strap hinge between an open position and a closed position relative to the substrate by bending the strap hinge; and a camming structure on the cover that includes a camming surface on one side that interacts with the substrate so as to bias the cover toward the open position relative to the substrate, wherein the camming structure further includes a curved surface opposite the camming surface that acts as a hinge guide around which at least a portion of the elongate strap hinge contacts and bends when the cover is selectively moved to the closed position relative to the substrate so that the elongate strap hinge bends over a significant portion of its entire length.

18. A latch device as recited in claim 1, further including a bearing protrusion on the cover corresponding to the slot.

* * * * *